US005301508A

United States Patent [19]

Kahl et al.

[11] Patent Number: 5,301,508

[45] Date of Patent: Apr. 12, 1994

[54] THERMOELECTRIC PORTABLE CONTAINER

[75] Inventors: W. Henry Kahl, Wooster, Ohio; James M. Kerner, Chico, Calif.; James A. Schillinger, Augusta, Kans.; Neil R. Taylor, Alameda, Calif.

[73] Assignee: Rubbermaio Incorporated, Wooster, Ohio

[21] Appl. No.: 930,009

[22] Filed: Aug. 14, 1992

[51] Int. Cl.[5] ..... F25B 21/02

[52] U.S. Cl. ..... 62/3.62; 16/125; 16/126; 439/501; 220/402; 62/3.6

[58] Field of Search ..... 62/3.2, 3.3, 3.6, 3.62; 190/115, 39; 16/125, 126, 127; 439/4, 501; 220/4.02

[56] References Cited

U.S. PATENT DOCUMENTS

| | | | |
|---|---|---|---|
| 2,874,205 | 2/1959 | Race | 439/501 |
| 3,111,166 | 11/1963 | Munz et al. | 165/30 |
| 3,194,023 | 7/1965 | Sudmeier | 62/3 |
| 4,089,184 | 5/1978 | Beitner | 62/3 |
| 4,107,934 | 8/1978 | Beitner | 62/3 |
| 4,274,262 | 6/1981 | Reed et al. | 62/3 |
| 4,297,850 | 11/1981 | Reed | 62/3 |
| 4,326,383 | 4/1982 | Reed et al. | 62/3 |
| 4,346,562 | 8/1982 | Beitner | 62/3 |
| 4,759,190 | 7/1988 | Trachtenberg et al. | 62/3 |
| 4,981,019 | 1/1991 | Hicks et al. | 62/3.62 |
| 5,060,479 | 10/1991 | Carmi et al. | 62/362 |

OTHER PUBLICATIONS

"Tropicool" brochure (6 pp.), 1991, WAECO-Wähning & Co. GmbH, D-4407 Emsdetten, Postfach 11 44, Sinninger Strasse 36.

Igloo® 1992 Product Catalog and Price List, Igloo Products Corp., P.O. Box 19322, Houston, Tex. 77224-9322, pp. 2-3.

1991 Coleman Outdoor Products, Inc., The Coleman Company, Inc. 250 North St. Francis, Wichita, Kans. 67202, pp. 37-39.

*Primary Examiner*—John M. Sollecito

*Attorney, Agent, or Firm*—Renner, Kenner, Greive, Bobak, Taylor & Weber

[57] ABSTRACT

A container (20) includes a base surface (25) having walls (21, 22, 23 and 24) extending therefrom which together form an opening for the container (20). A door (26) is attached to one wall (24) by a hinge (27) to close the opening. A thermoelectric power module (43) is removably mounted in a recess (66) formed in one wall (21) and selectively heats and cools the interior of the container (20). The container (20) may thus be selectively positioned on either the base surface (25) or on one of two walls (22, 23). A power cord (57) is attached to the module (43) and carries a plug (58) so that the module (43) may be connected to a source of electric power. A switch (61) on the plug (58) directs the module (43) to selectively cool or heat the interior of the container (20). The cord (57) may be routed in channels (70, 72, 73, 74) formed in the base surface (25) from module (43) to any of the walls (22, 23, 24) and may be stored in a recess (77) formed in the base surface (25) and wall (24). A handle assembly (42) is positioned near the top of the walls (22, 23) to be recessed therein and includes a gripping portion (82) with arms (83) extending from the ends thereof. The arms (83) are received through apertures (91) formed in pockets (90) formed near the top of the walls (22, 23) and engage ledges (92) at the bottom of the pockets (90) to maintain the handle assemblies (42) in the pockets (90) when they are lifted and rotated to carry the container (20).

78 Claims, 7 Drawing Sheets

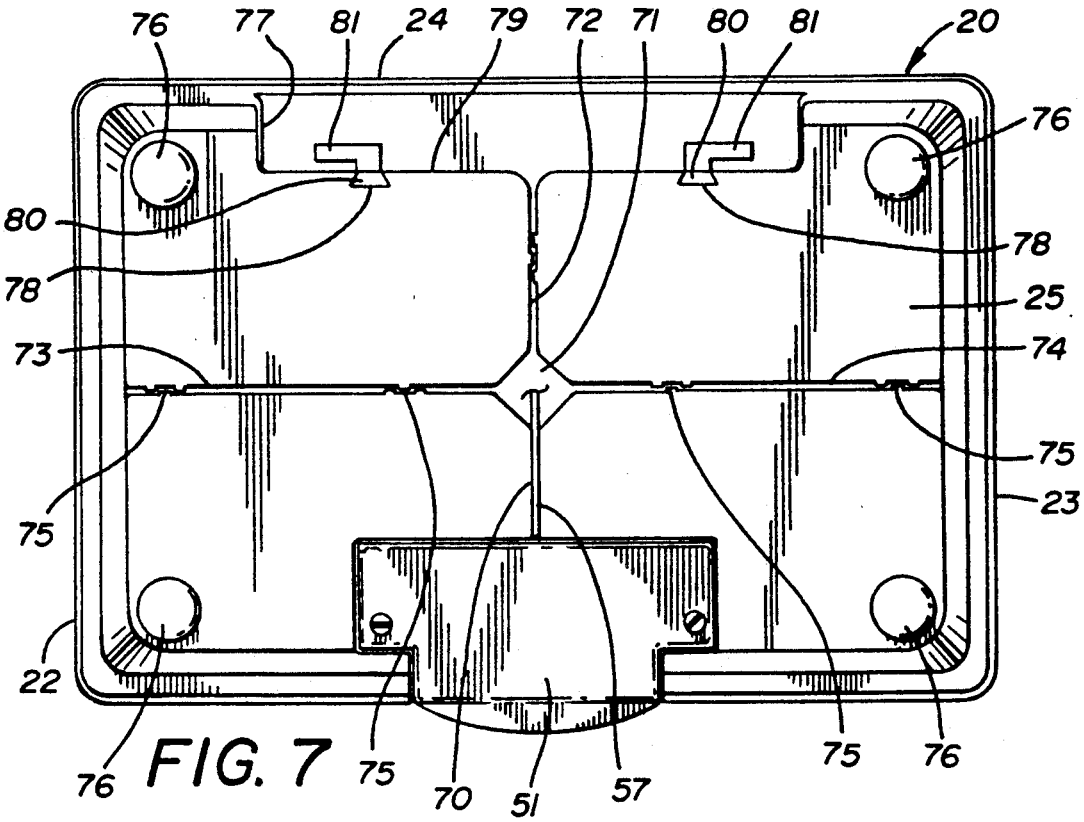
FIG. 7
FIG. 8
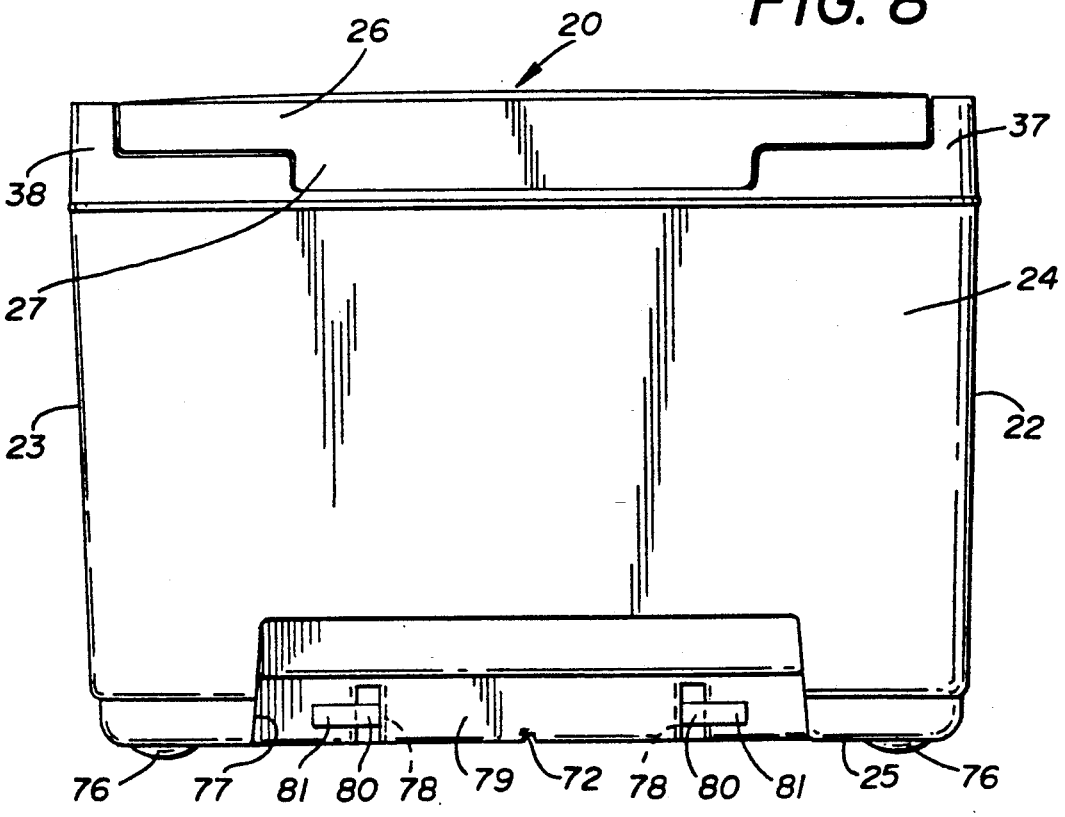

THERMOELECTRIC PORTABLE CONTAINER

TECHNICAL FIELD

This invention relates to a portable thermoelectric container. More specifically, this invention relates to such a container which is electrically powered to maintain food products cool or warm, as desired.

BACKGROUND ART

Thermoelectric containers which can selectively maintain food products cool or warm are known in the art. When manufactured of a size to be readily transported by the user, such as an outdoorsman, such a device not only eliminates the need for an ice chest but also provides the additional benefit of actually being able to heat food contained therein.

Most known thermoelectric containers have a thermoelectric unit permanently positioned in the top or on one side thereof with its heat exchanging fins disadvantageously protruding into the container. Such positioning also does not permit the container to be selectively placed by the user in both a horizontal or vertical position because in one of those positions, the container may be resting with the thermoelectric unit on the bottom thereby detrimentally cutting off its air supply. Thus, for example, a container, which when in a horizontal position much like an ice chest has its hinged cover on the top and the thermoelectric unit on the side, can only be placed in one upright, refrigerator-like, position, with the cover at the front, because in the other possible upright position, the thermoelectric unit would be smothered. Thus, such containers do not provide the advantageous, and often desirable, right hand/left hand opening option when in the upright position. In addition, the permanent positioning of the thermoelectric unit, wherever positioned, makes maintenance and repair of the unit difficult, if not impossible, for the user.

The power cord which extends from the thermoelectric unit also presents problems for the user. For example, if the cord is permanently attached to the unit and thus the container, the cord often presents a nuisance when the container is being transported, and the plug carried by the cord can be damaged, as by being stepped on. Many thermoelectric containers utilize removable cords thereby eliminating these problems. But over time, the insertion and removal of the plug can cause a poor electrical connection increasing electrical resistance often resulting in a burning or melting of the plug housing.

When utilizing removable plugs, the electronics of the device have been arranged such that when plugging the cord into the unit in one direction, the unit will cool the container. By simply turning the plug over, the unit can be directed to heat the container. This can be a problem to the user in that if he forgets whether he was heating or cooling during the previous use, he might in a subsequent use inadvertently heat the container when he wanted to cool it, or vice versa.

To transport most prior art thermoelectric containers which are intended to be portable, most often some type of handles are provided. In many such containers, when not in use the handles interfere with the compact placement of the container. In addition, since the container must be insulated for thermal efficiency, usually the insulation is interrupted at the area of the prior art handles thereby diminishing the overall thermal efficiency of the containers.

Thus, the need exists for a portable thermoelectric container which can be positioned vertically in one of two positions and horizontally as well; which is provided with a thermoelectric power module which is readily removable for ease of maintenance; which utilizes a cord permanently attached to the thermoelectric module and yet provides for proper routing of the cord when in use and storing of the cord when not in use; which provides the user with an easy manner in which to change the mode of the unit from heating to cooling with a visual indication thereof; and which can be carried by handles which can be recessed out of the way when not in use, and which do not detract from the thermal efficiency of the container.

DISCLOSURE OF THE INVENTION

It is thus an object of the present invention to provide a portable thermoelectric container which is selectively cooled or heated by a thermoelectric power module which has no components protruding into the container and which is removably positioned in the container for ease of maintenance.

It is another object of the present invention to provide a thermoelectric container, as above, in which the thermoelectric power module is positioned so as to permit the container to be utilized in a horizontal position with its cover or door on the top thereof and in two alternative vertical positions with its cover or door opening from the right or left.

It is a further object of the present invention to provide a thermoelectric container, as above, in which the power cord is integrally attached to the power module and can be conveniently routed to the power source without exposing the cord to damage and without effecting the stability of the container when positioned on a surface.

It is an additional object of the present invention to provide a thermoelectric container, as above, in which the power cord can be conveniently stored, recessed within the profile of the container, when not in use.

It is yet another object of the present invention to provide a thermoelectric container, as above, in which the cooling/heating mode of operation of the thermoelectric module can be readily changed with a visual indication of the current operating mode being provided.

It is a still further object of the present invention to provide a thermoelectric container, as above, which is rendered portable by handles which can be recessed out of the way when not in use without detriment to the insulation of the container.

These and other objects of the present invention as well as the advantages thereof over existing prior art forms, which will become apparent from the description of the preferred embodiment to follow, are accomplished by the improvements hereinafter described and claimed.

In general, a container made in accordance with one aspect of the present invention includes a base surface, first opposed walls extending from the base surface, and second opposed walls extending from the base portion. Together, the first and second opposed walls form an opening for the container which may be closed by a door hinged to one of the first opposed walls. A thermoelectric power module is positioned in one of the first opposed walls to selectively cool or heat the interior of the container. The container is thus selectively positionable on the base surface or on either of the second opposed walls.

In accordance with other aspects of the invention, means are provided to removably position the thermoelectric module in its wall. Also, the module is provided with a power cord which carries a plug member to connect the module to a source of electric power. A switch is associated with the plug member to direct the module to selectively cool or heat the interior of the container, as desired.

Another aspect of the present invention relates to the fact that the cord can be routed within the base surface generally to the center thereof and then selectively toward any wall desired. If it is desired to store the cord when the container is not in use, it may be routed to and stored in a recess formed in the base surface and one of the walls.

The container may also be transported by accessing recessable handle assemblies made in accordance with another aspect of the present invention. Each handle assembly includes a generally U-shaped handle having a gripping portion and arm members extending from the ends thereof. The arm members are received in apertures near the top of either of the opposed walls so that the gripping portion is normally recessed within the profile of the walls. Means are provided to maintain the arm members within the apertures so that when the gripping portions are lifted, the handles may be rotated and used to lift the container.

A preferred exemplary thermoelectric container incorporating the concepts of the present invention is shown by way of example in the accompanying drawings without attempting to show all the various forms and modifications in which the invention might be embodied, the invention being measured by the appended claims and not by the details of the specification.

BRIEF DESCRIPTION OF THE DRAWINGS

FIG. 7 is a bottom plan view of the thermoelectric container oriented as shown in FIG. 1.

FIG. 8 is a rear elevational view of the thermoelectric container oriented as shown in FIG. 1.

PREFERRED EMBODIMENT FOR CARRYING OUT THE INVENTION

Figure 1:
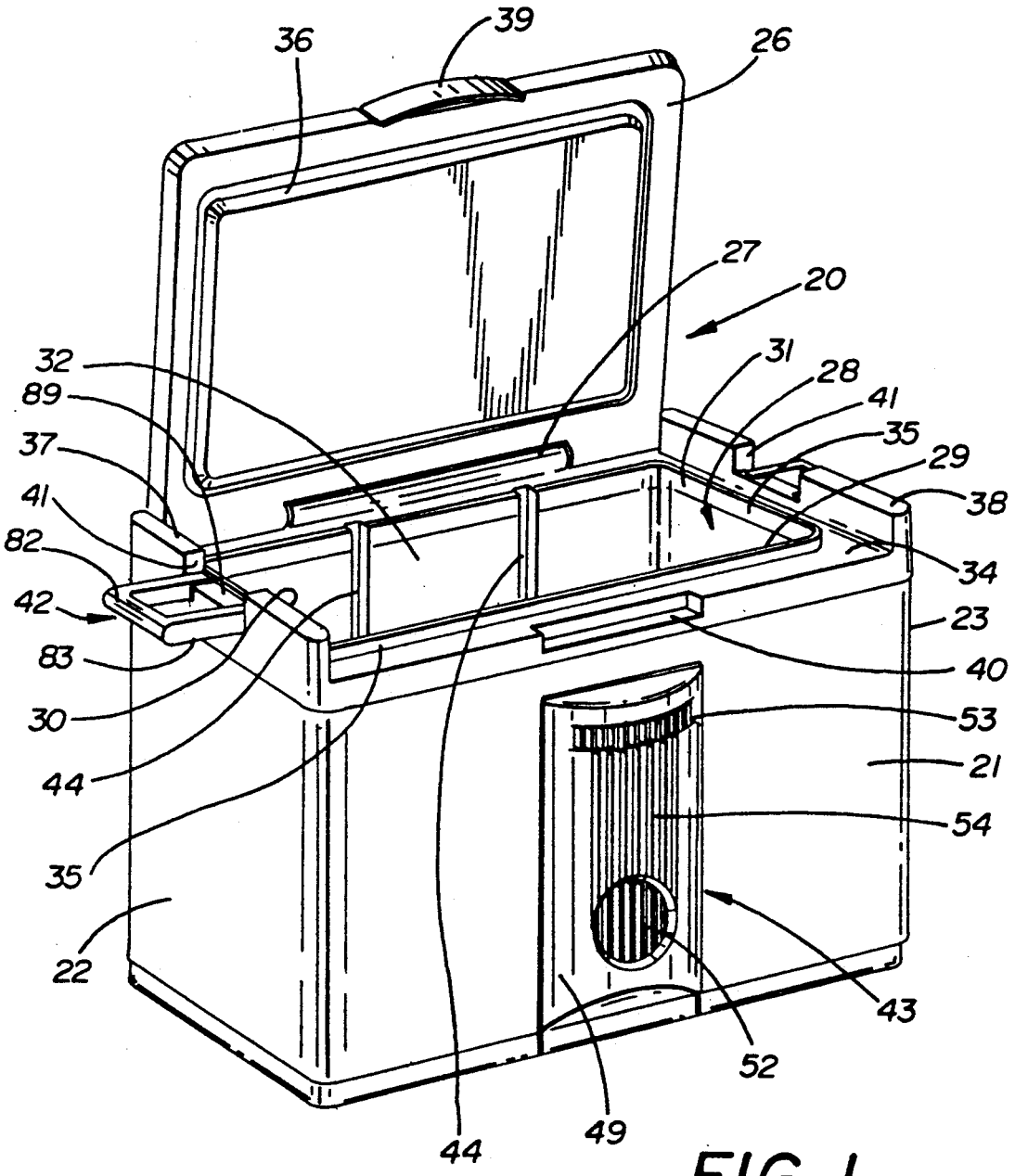
FIG. 1 is a perspective view of a thermoelectric container made in accordance with the concepts of the present invention shown in a generally horizontal orientation having its cover or door opening at the top, and having its handles in their operable position.

A thermoelectric container made in accordance with the concepts of the present invention is indicated generally by the numeral 20 in the drawings and is preferably constructed of a suitable plastic material such as polypropylene. Container 20 is shown in a generally horizontal orientation in FIG. 1, and in that orientation, includes a front wall 21, side walls 22 and 23, and a rear wall 24, all extending upwardly from a base surface 25 (which is the bottom surface in this orientation) to form a generally open top which is closeable by means of a cover or door 26 conventionally hinged, as at 27, near the top of rear wall 24. Walls 21, 22, 23 and 24 thus form the exterior profile of container 20.

An inner liner, generally indicated by the numeral 28, has a similar profile which includes a front wall 29, side walls 30 and 31, and a rear wall 32, all extending upwardly from a base liner surface 33. Liner 28 is inwardly spaced from the exterior profile of container 20. Thus, wall 21 is spaced from wall 29, side walls 22 and 23 are spaced from side walls 30 and 31, respectively, rear wall 24 is spaced from rear wall 32, and bottom surface 25 is spaced from bottom liner surface 33. The space between these surfaces may be substantially filled with any suitable insulation material to maintain the contents of container 20 hot or cold, as desired.

Figure 3:
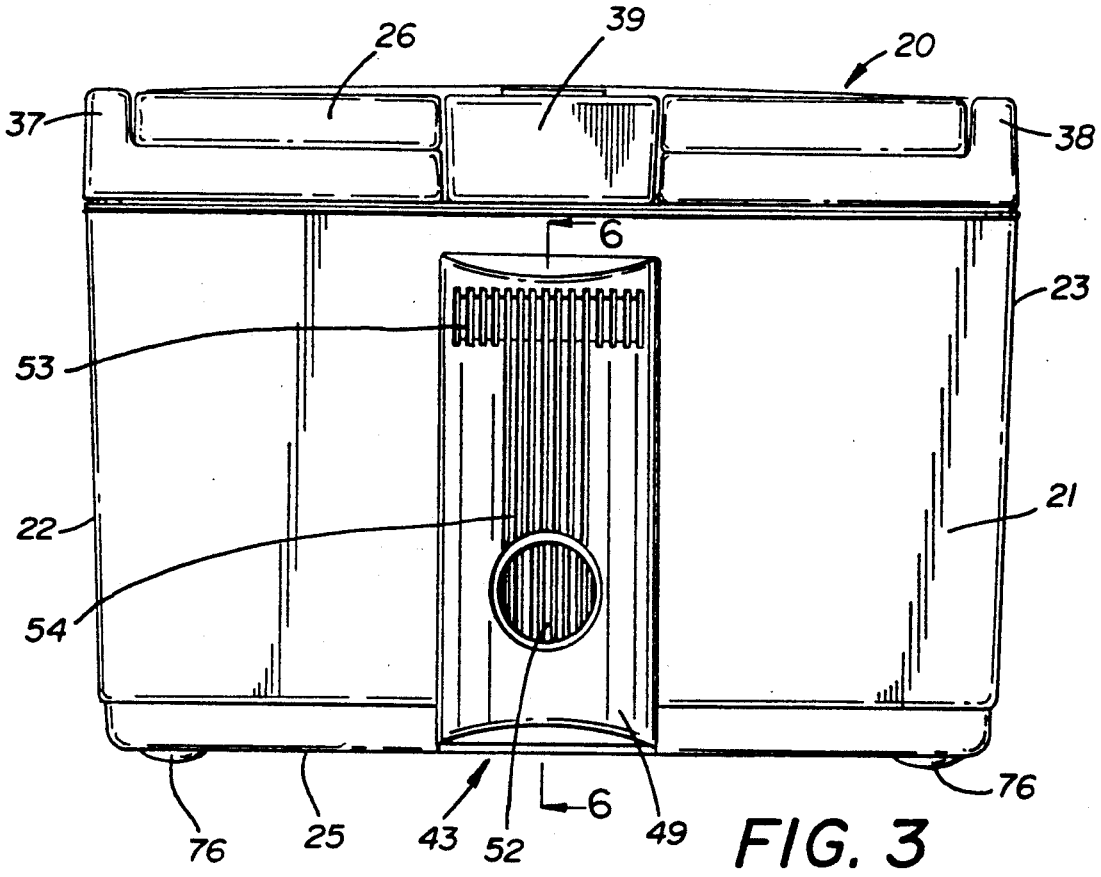
FIG. 3 is a front elevational view of the thermoelectric container oriented a shown in FIG. 1.

An upper peripheral shelf 34 is formed between the top of inner liner 28 and the top of the outer profile of container 20, and preferably is internally formed as part of the liner 28 itself. A peripheral rim 35 extends upwardly from shelf 34, at the inner periphery thereof, and is adapted to receive a similarly configured rim 36 extending downwardly from cover 26. The upper ends 37 and 38 of side walls 22 and 23, respectively, extend above shelf 34, and when in the closed position (FIG. 3), the lateral edges of cover 26 fit therebetween, thus recessing cover 26 within the profile of side walls 22 and 23. A latch 39 of any conventional configuration may be provided on the front edge of cover 26 and received within a recess 40 formed at the top of front wall 21 and in shelf 34.

Figure 4:
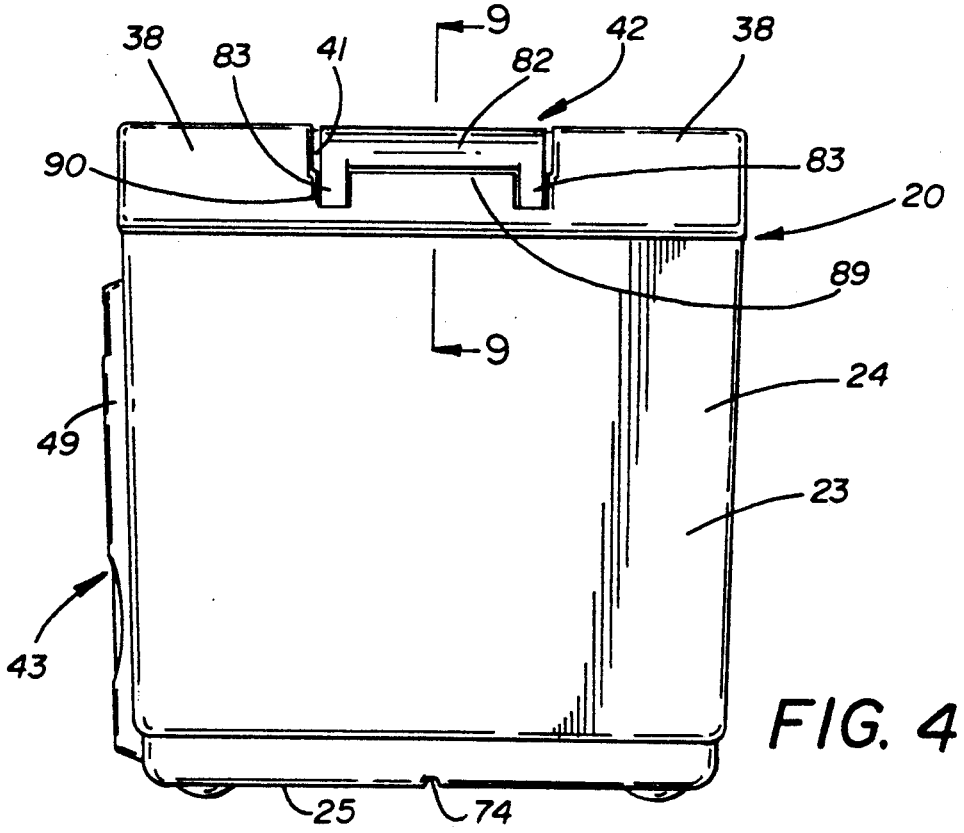
FIG. 4 is a side elevational view of the thermoelectric container oriented as shown in FIG. 1.

The upper ends 37 and 38 of side walls 22 and 23, respectively, are interrupted, as at 41, and handle assemblies, generally indicated by the numeral 42, are positioned in the interruptions 41 of upper ends 37 and 38 of walls 22 and 23, respectively. As will hereinafter be described in more detail, FIG. 1 shows handle assemblies 42 in their operating position whereby container 20 may be readily carried, and FIGS. 2 and 4 show them telescopically recessed within interruptions 41 and generally flush with the top of upper ends 37 and 38 of side walls 22 and 23, respectively.

In a manner to be hereinafter described, a thermoelectric power module, generally indicated by the numeral 43, is positioned in front wall 21 and provides for the internal cooling and heating of container 20 in a fashion known to one skilled in the art. Because of the positioning of module 43 in front wall 21, that is, the wall opposite to the wall on which cover 26 is hinged, container 20 can be advantageously positioned in one of two vertical positions, one of which is shown in FIG. 2.

Figure 2:
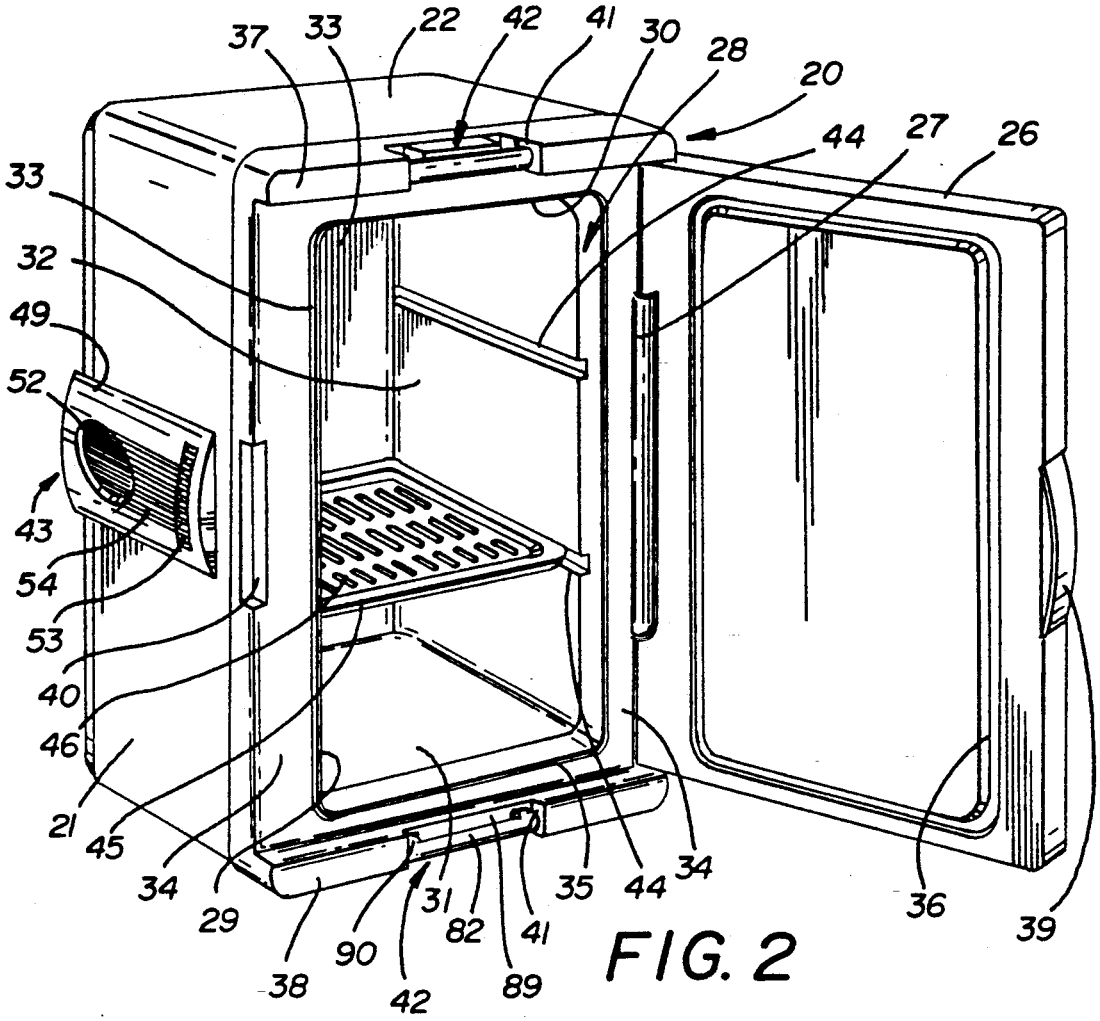
FIG. 2 is a perspective view of the thermoelectric container of FIG. 1 shown in one of its two possible vertical positions, and having its handles retracted or recessed.

In FIG. 2, container 20 is shown as being positioned on side wall 23, which thus becomes its bottom surface in this orientation, with side wall 22 thereby becoming the top wall of container 20, front wall 21 and rear wall 24 becoming its side walls, and bottom 25 becoming its rear wall. As such, cover or door 26 now swings with its hinge 27 on a vertical axis along the right hand side of container 20, much like the opening and closing of a refrigerator. In this orientation, because of the presence of end 38 of wall 23, door 26 is vertically positioned above the ground so that the ground will not interfere therewith upon opening and closing.

It should also be appreciated that, although not depicted in the drawings, container 20 could be positioned on side wall 22 which would thus become its bottom surface, with side wall 23 becoming the top surface. Door 26 would then swing from the left hand side of container 20 in this vertical orientation. Thus, due to the placement of module 43, the three described orientations of container 20 are possible. Of course, such orientations would be possible if module 43 were also positioned in back wall 24, but would not be possible if positioned in either side wall 22 or 23 because then container 20 would be suffocating the air intake of module 43 if it were sitting thereon.

Rear wall 32 of inner liner 28 can also be provided with a plurality of spaced grooves 44 aligned with similar grooves on front wall 29 of liner 28. The aligned grooves can act to receive one or more shelves 45 when container 20 is in its two possible vertical orientations, as shown in FIG. 2, or shelves 45 can be used as dividers when container 20 is in the horizontal FIG. 1 position. Shelves 45 may be provided with a plurality of vent apertures 46 so as not to inhibit air circulation within container 20.

Figure 5:
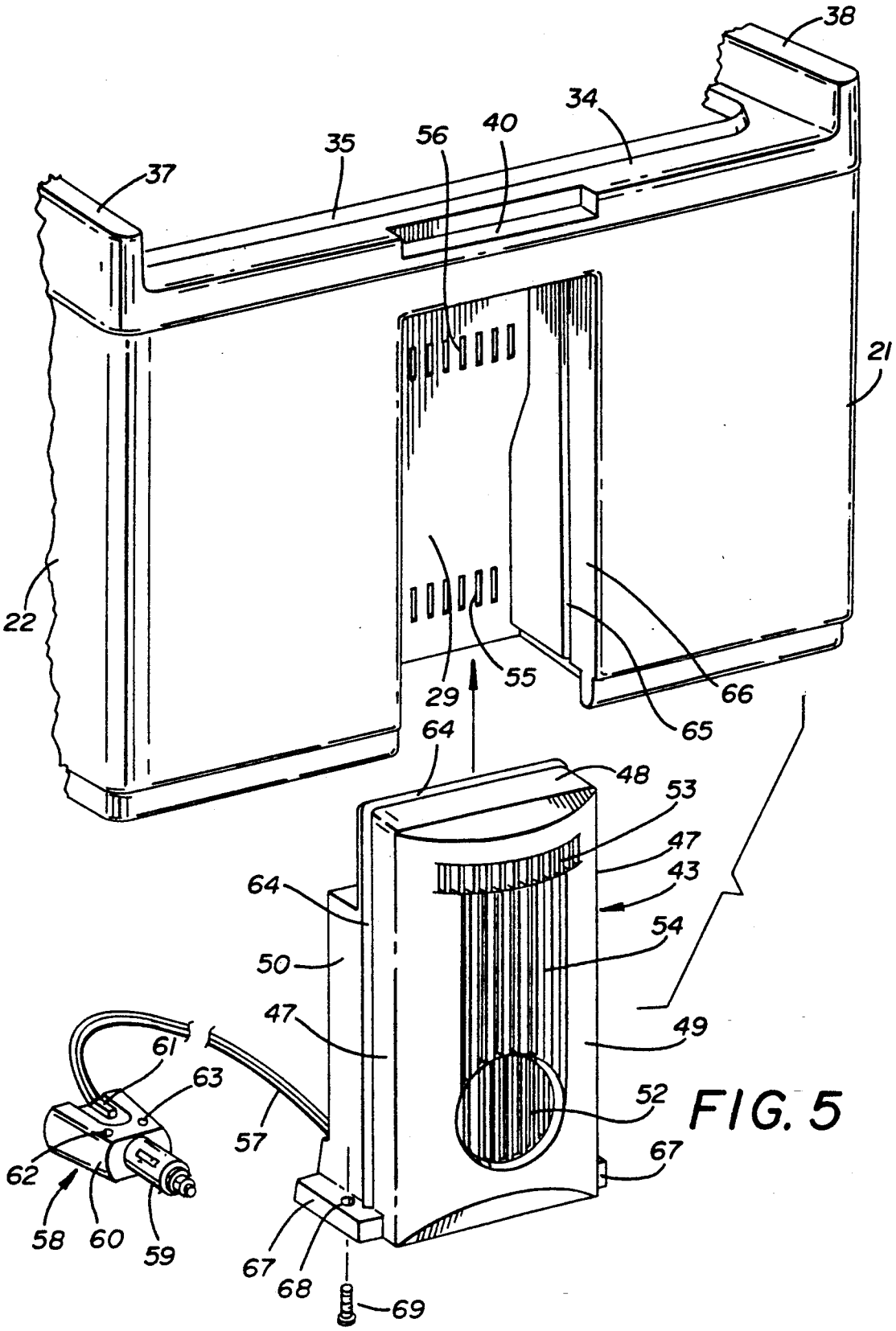
FIG. 5 is an exploded, fragmented, perspective view showing the manner in which the thermoelectric power module is positioned in the thermoelectric container.

Thermoelectric power module 43 is best shown in FIG. 5 as having a generally rectangular body portion which includes generally vertical side walls 47, a generally horizontal top wall 48, and an arcuate front face 49. A pedestal 50 extends rearwardly of the body portion. Together, the body portion and pedestal 50 have a common bottom surface 51 (FIG. 7). The body portion and pedestal 50 house the components necessary to provide cooling or heating to container 20. The specific components involved play no part of the present invention and thus can include the conventional heat exchanger technology, as is well known in the art, wherein air is taken in through module 43 cooled or heated, and then transmitted to the inside of container 20. To that end, arcuate face 49 is provided with lower air intake vents 52 and upper air exhaust vents 53. Decorative ribbing 54 can be provided between vents 52 and 53 to accentuate their presence to the user so that he does not inadvertently position container 20 so as to suffocate vents 52 and 53. Similar vents on the back of module 43 (not shown) communicate with vents 55 and 56 in the front wall 29 of liner 28 so that cooling or warming air is provided internally of container 20.

Module 43 is preferably intended to operate on a twelve volt, DC source, but could, for example, operate off of other power, such as 24 volts. To that end, a power cord 57 is permanently molded integrally with module 43 and extends from the bottom of the back thereof. Cord 57 preferably carries a plug, generally indicated by the numeral 58, which includes a tip portion 59 suitable for being received in a conventional automotive cigarette lighter. Thus, container 20 can be operated while being carried in a vehicle. Likewise, tip portion 59 can also be inserted into a conventional AC to DC converter which is plugged into the normal AC household power lines so that container 20 can likewise be used in the home environment.

Plug 58 is also shown as having a body member 60 with a power selecting switch 61 incorporated therein. Switch 61 is electrically coupled to module 43 in a manner as would be known to one skilled in the art so that if it is in one position, module 43 is in a cooling mode and if in the other position, module 43 is in the heating mode. To provide a visual indication not only of the fact that module 43 is receiving power but also of whether it is in the cooling mode or warming mode, two light emitting diodes 62, 63 may be provided in plug body member 60. Thus, diode 62, for example, may emit a green light indicative that module 43 is in the cooling mode, and diode 63 may emit a red light indicative of the heating mode. As such, the user will always be made aware of the current operating mode of module 43, and he will not be inadvertently heating when cooling is desired, or vice versa.

Figure 6:
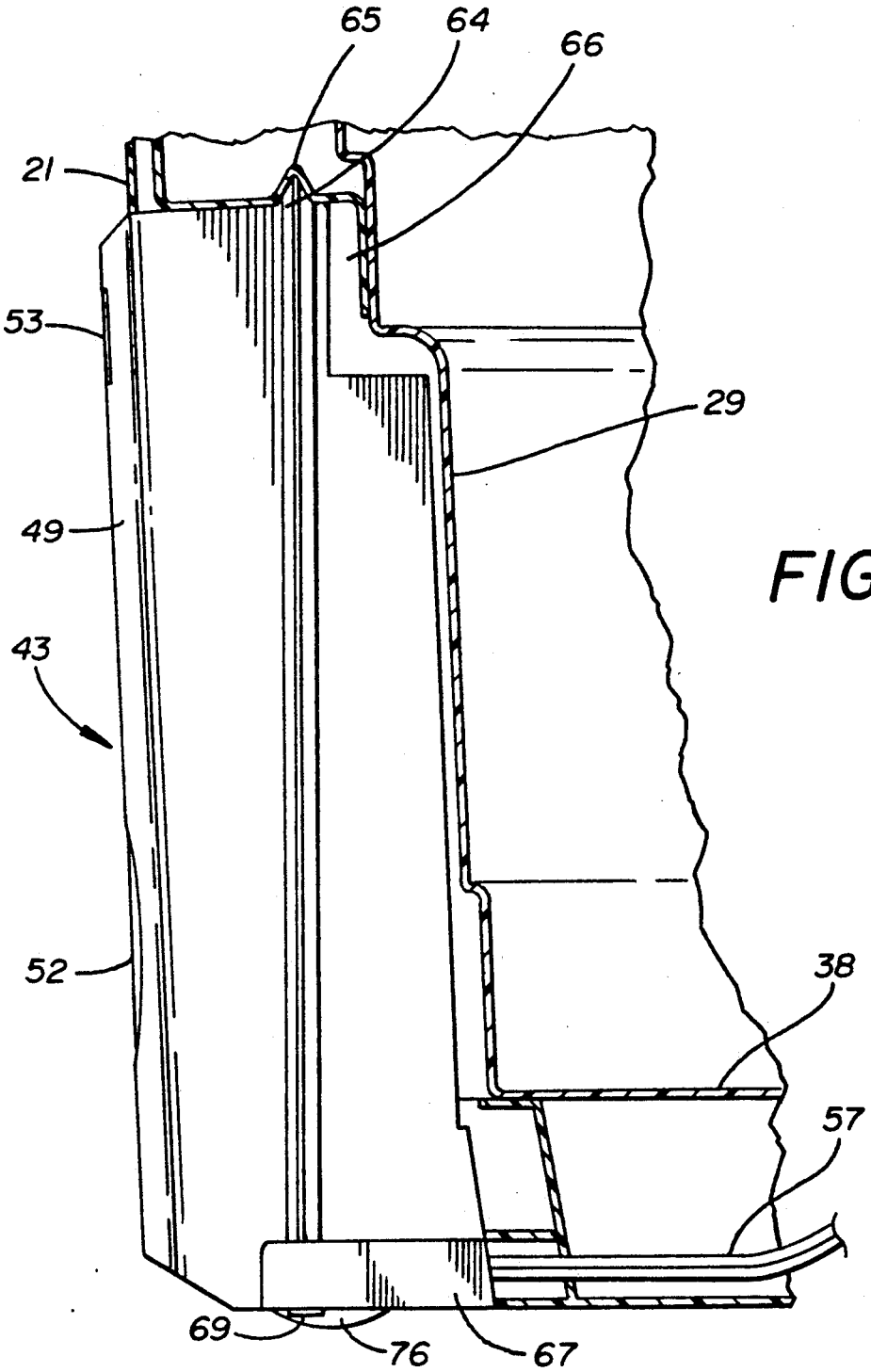
FIG. 6 is a fragmented sectional view taken substantially along line 6—6 of FIG. 3 with the module being shown in elevation.

As best shown in FIGS. 5 and 6, module 43 is readily removably positioned in front surface 21 of container 20. To that end, a continuous peripheral rail 64 extends outwardly from walls 47 and wall 48 of module 43. Rail 64 is received in a complementary recessed track 65 positioned in the side and upper walls of a recess 66 formed in front wall 21 of container 20. Thus, in order to insert module 43 into container 20, one need only slide it upwardly within recess 66 with rail 64 being positioned in track 65 to maintain module 43 laterally within recess 66. To maintain module 43 vertically within recess 66, wing flanges 67, having apertures 68 therein, extend outwardly from module side walls 47 and from pedestal 50. Fasteners 69 may then be positioned through apertures 68 and into the bottom of the side walls of recess 66 to hold module 43 in place. Thus, if module 43 is in need of repair or replacement, only fasteners 69 need be removed and module 43 can be slid out of container 20. This arrangement is also advantageous in that module 43 is positioned entirely outside of front liner wall 29 and thus outside of container 20. Most prior art thermoelectric units required that the heat exchanging fins protruded to the inside of the unit which, of course, not only prohibited them from being removed, but made cleaning of the container at the area of the unit more difficult.

The bottom surface 25 of container 20 is best shown in FIG. 7. A cord routing channel 70, shown as having cord 57 positioned therein, extends from module recess 66 toward the center of bottom surface 25 and terminates at central recessed routing junction 71. Cord routing channels 72, 73 and 74 also extend outwardly from junction 71, channel 72 extending toward rear wall 24, channel 73 extending toward side wall 22 and channel 74 extending toward side wall 23. Each channel 70, 72, 73 and 74 is provided with one or more cord gripping assemblies 75 which, when cord 57 is pushed into a channel 70, 72, 73 or 74, will hold cord 57 securely within that channel. Cord 57 can thus be held flush with bottom surface 25 or possibly slightly therebelow. In the latter instance, bottom feet 76 can be provided near each corner of bottom surface 25 to raise container 20 off of the floor when in the horizontal FIG. 1 position, or maintain container 20 away from a wall which it might be positioned adjacent thereto when in the vertical position such as shown in FIG. 2. Routing channels 70, 72, 73 and 74 thus permit cord 57 to be most conveniently directed to its desired termination point. Thus, for example, if plug tip portion 59 is to be inserted at a location adjacent side wall 23, cord 57 is routed from module 43 through channel 70 to junction 71 whereat it may be turned and routed through channel 74 to pass through the bottom of side wall 23.

Container 20 also includes means by which cord 57 may be conveniently stored therein when container 20 is not in use or when it is being transported. Such is shown in FIGS. 7 and 8 and includes a storage recess 77 formed in the bottom surface 25 and rear wall 24 of container 20. Two dove-tail slots 78 extend upwardly within the inner wall 79 of recess 77 from bottom surface 25. Slots 78 are adapted to receive complementary shaped lugs 80 having pegs 81 extending generally laterally therefrom. When container 20 is not in use, cord 57 may be routed through channel 72 and into recess 77 to be wound around pegs 81 to thereby maintain cord 57 out-of-the-way within recess 77.

Figure 11:
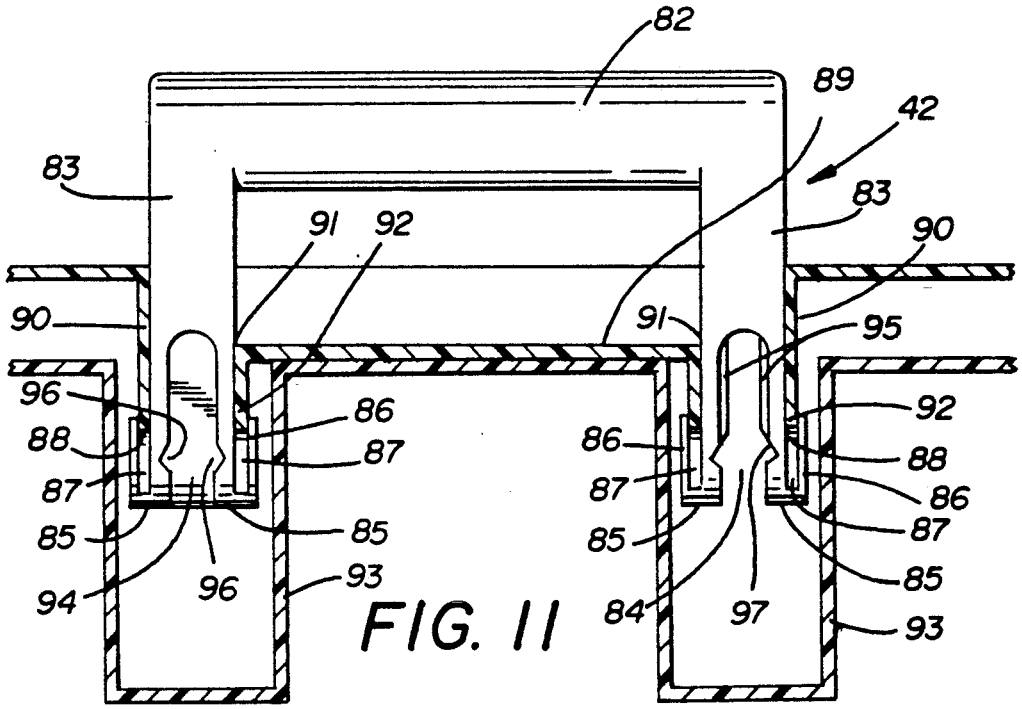
FIG. 11 is a sectional view taken substantially along line 11—11 of FIG. 10.
Figure 9:
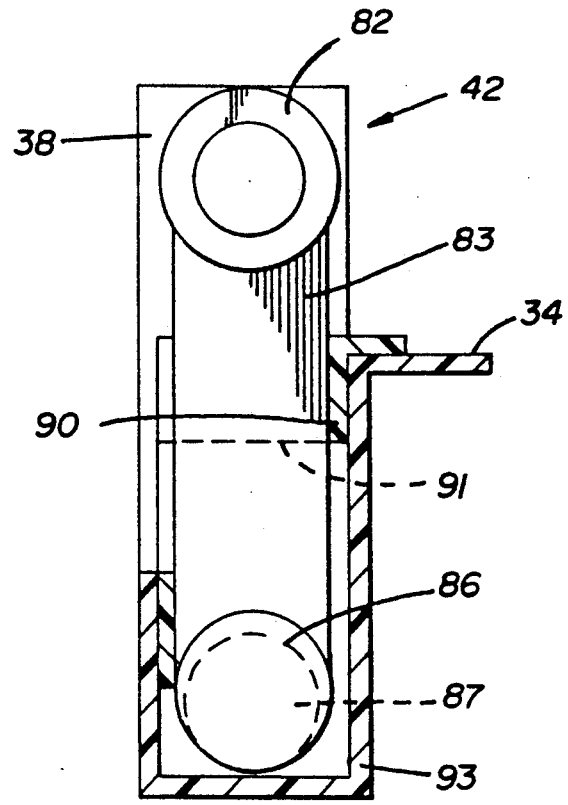
FIG. 9 is a sectional view taken substantially along line 9—9 of FIG. 4.
Figure 10:
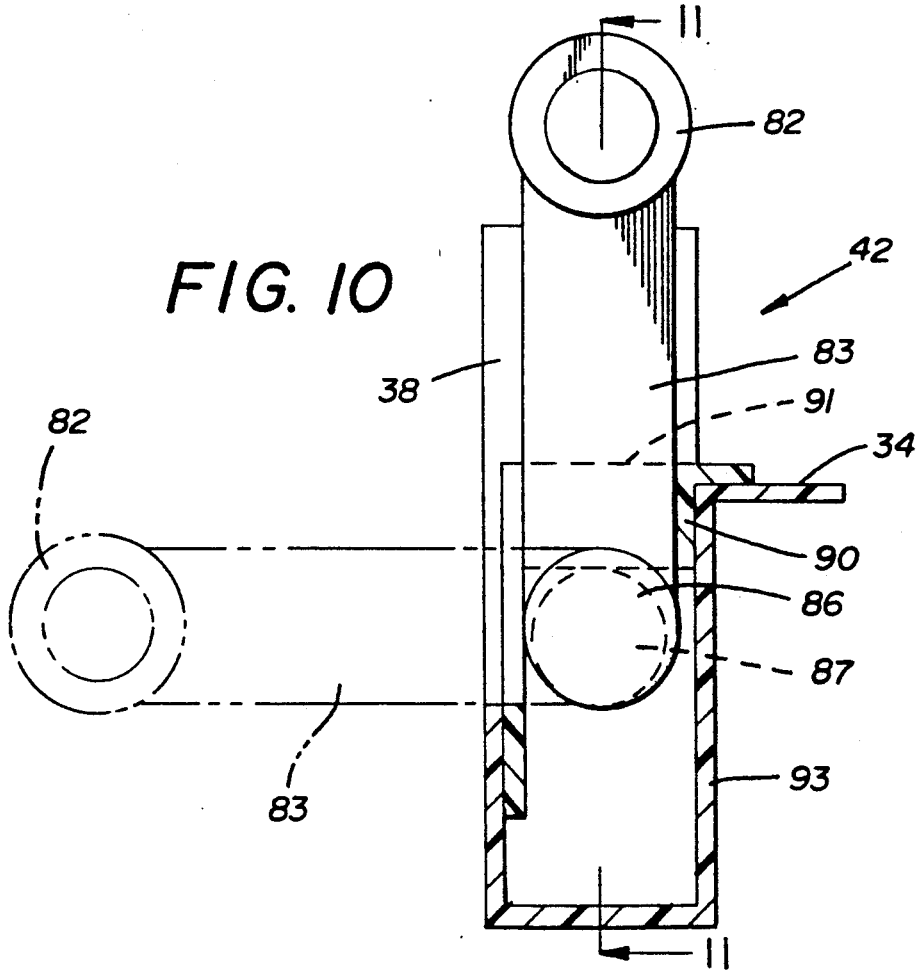
FIG. 10 is a sectional view similar to FIG. 9 but showing the handle in an extended position and in the operable position in phantom.

The preferred construction of handle assemblies 42 and the manner in which they can be recessed within container 20 are best shown with reference to FIGS. 9–11. As previously described, container 20 is preferably provided with two handle assemblies positioned near the top of side walls 22 and 23 and their associated liner side walls 30 and 31. Each handle assembly 42 includes a relatively U-shaped handle having a gripping portion 82 and arms 83 extending inwardly from the ends thereof. As shown in FIG. 11, the inner end of each arm 83 is axially split, as at 84, thereby forming tine ends 85. The laterally outer sides of each tine end 85 are provided with generally circular embossments 86 which are spaced from tine ends 85 by hubs 87 of a slightly lesser diameter than embossments 86 thereby forming a slot opening 88 between the top of embossments 86 and tine ends 85.

Handle assemblies 42, as previously described, are positioned within interruption 41 of upper ends 37 and 38 of side walls 22 and 23 respectively. At the location of interruptions 41, a flat shelf 89 is formed having pockets 90 therein within which the inner ends of handle arms 83 are received when the handles are in their operating position as shown in FIG. 1. The bottom of pockets 90 are open, as at 91, into the space between the liner walls 30 and 31 and side walls 22 and 23, respectively, thereby forming lower ledges 92. The opening 91 is of a lesser size than the distance between the outer edges of embossments 86 on tine ends 85. To insert the handles, tine ends 85 are squeezed together permitting the lower ends of arms 83 to pass through opening 91 whereupon tine ends 85 will spread apart and the handle will drop until gripping portion 82 is resting on shelf 89, the position shown, for example, in FIGS. 2, 8 and 9. Arms 83 are thus positioned within lower pockets 93 formed between side walls 22 and 23 and liner side walls 30 and 31, respectively. Pockets 93 not only serve the purpose of isolating handle arms 83 from the insulation received therein, but also prevent the insulation from coming out through openings 91. Thus, container 20 may be fully insulated around the handles, leaving no voids therein as may be found in the prior art, thereby providing a more thermally efficient unit.

When it is desired to utilize the handles for carrying container 20, gripping portion 82 thereof is merely lifted from the FIG. 9 to the FIG. 10 solid line position. However, they cannot be totally removed back through opening 91 because, as best shown in FIG. 11, slot openings 88 between embossments 86 and tine ends 85 engage lower ledges 92 at the bottom edge of opening 91 to limit the permissible amount of upward movement of the handles. The handles can then be rotated 90. to the phantom line position of FIG. 10, and as also shown in FIG. 1, so that container 20 can be readily transported.

To assure that slot openings engage ledges 92 and to also assure that tine ends 85 do not collapse toward each other and accidentally pass back through opening 91, before pockets 93 have been put in place, a plug member 94 may be inserted into the split 84 which forms tine ends 85. For ease of description, FIG. 11 shows one plug member 94 in place, it being understood that both arms 83 are preferably provided with a plug member 94. Each plug member has opposed slots (not shown) therein which may be guided upwardly on tracks 95 formed on the inside of tine ends 85. Pointed lugs 96 extend outwardly from each plug member 94 to engage a complementary shaped recess 97 formed on the inside of tine ends 85 adjacent tracks 95. When plug members 94 are fully inserted, lugs 96 snap into recess 97 to assure that tine ends 85 are spread sufficiently to assure their positioning within pockets 90.

It should thus be appreciated that a thermoelectric container constructed in accordance with the concepts of the present invention, as described herein, accomplishes the objects of the present invention and otherwise substantially improves the art.

We claim:

1. A container comprising a base surface, first opposed walls extending from said bas surface, second opposed walls extending from said base surface, together said first opposed walls and said second opposed walls forming an opening for the container opposite to said base surface, a door for closing said opening, hinge means attaching said door to one of said first opposed walls, a recess formed in one of said first opposed walls, and thermoelectric power means slidably received in said recess to selectively cool or heat the interior of the container, the container thus being positionable selectively on said bas surface or either of said second opposed walls.

2. A container according to claim 1 wherein said hinge means is positioned on one of said first opposed walls opposite to the one of said first opposed walls in which said thermoelectric power means is positioned.

3. A container according to claim 1 further comprising spaced grooves in each said second opposed wall, said spaced grooves in one of said second opposed walls being aligned with said spaced grooves in the other of said second opposed walls, and means positioned in at least two of said aligned grooves to act as a shelf when the container is positioned on either of said second opposed walls and as a divider when the container is positioned on said base surface.

4. A container according to claim 1 further comprising means to removably position said thermoelectric power means in said recess in said one of said first opposed walls.

5. A container according to claim 4 further comprising a power cord attached to said thermoelectric power means, plug means carried by said cord to connect said thermoelectric power means to a source of electric power, and switch means associated with said plug means to direct said thermoelectric power means to selectively cool or heat the interior of the container.

6. A container according to claim 4 further comprising a power cord attached to said thermoelectric power means, and means in said base surface to direct said cord to generally the center thereof and then selectively toward any of said walls.

7. A container according to claim 4 further comprising a power cord attached to said thermoelectric power means, and means formed in said base surface and at least one of said walls to receive said cord for storing the same.

8. A container according to claim 4 further comprising a handle assembly positioned near the top of each of said second opposed walls, each said handle assembly including a generally U-shaped handle having a gripping portion and arm members extending from the ends thereof, said arm members being received within pocket apertures near the top of each said second opposed walls so that said gripping portion is normally recessed within the profile of each of said second opposed walls, and means to maintain said arm members within said pocket apertures so that when said gripping portion is lifted, said handle may be rotated and used to lift the container.

9. A container according to claim 8 further comprising a power cord attached to said thermoelectric power means, plug means carried by said cord to connect said thermoelectric power means to a source of electric power, and switch means associated with said plug means to direct said thermoelectric power means to selectively cool or heat the interior of the container.

10. A container according to claim 8 further comprising a power cord attached to said thermoelectric power means, and means in said base surface to direct said cord to generally the center thereof and then selectively toward any of said walls.

11. A container according to claim 8 further comprising a power cord attached to said thermoelectric power means, and means formed in said base surface and at least one of said walls to receive said cord for storing the same.

12. A container according to claim 11 further comprising plug means carried by said cord to connect said thermoelectric power means to a source of electric power, and switch means associated with said plug means to direct said thermoelectric power means to selectively cool or heat the interior of the container.

13. A container according to claim 11 further comprising means in said base surface to direct said cord to generally the center thereof and then selectively toward any of said walls.

14. A container according to claim 1 further comprising a power cord attached to said thermoelectric power means, plug means carried by said cord to connect said thermoelectric power means to a source of electric power, and switch means associated with said plug means to direct said thermoelectric power means to selectively cool or heat the interior of the container.

15. A container according to claim 14 further comprising means in said base surface to direct said cord to generally the center thereof and then selectively toward any of said walls.

16. A container according to claim 14 further comprising means formed in said base surface and at least one of said walls to receive said cord for storing the same.

17. A container according to claim 14 further comprising a handle assembly positioned near the top of each of said second opposed walls, each said handle assembly including a generally U-shaped handle having a gripping portion and arm members extending from the ends thereof, said arm members being received within pocket apertures near the top of each said second opposed walls so that said gripping portion is normally recessed within the profile of each of said second opposed walls, and means to maintain said arm members within said pocket apertures so that when said gripping portion is lifted, said handle may be rotated and used to lift the container.

18. A container according to claim 17 further comprising means in said base surface to direct said cord to generally the center thereof and then selectively toward any of said walls.

19. A container according to claim 17 further comprising means formed in said base surface and at least one of said walls to receive said cord for storing the same.

20. A container according to claim 19 further comprising means in said base surface to direct said cord to generally the center thereof and then selectively toward any of said walls.

21. A container according to claim 1 further comprising a power cord attached to said thermoelectric power means, and means formed in said base surface and at least one of said walls to receive said cord for storing the same.

22. A container according to claim 21 further comprising a handle assembly positioned near the top of each of said second opposed walls, each said handle assembly including a generally U-shaped handle having a gripping portion and arm members extending from the ends thereof, said arm members being received within pocket apertures near the top of each said second opposed walls so that said gripping portion is normally recessed within the profile of each of said second opposed walls, and means to maintain said arm members within said pocket apertures so that when said gripping portion is lifted, said handle may be rotated and used to lift the container.

23. A container according to claim 1 further comprising a handle assembly positioned near the top of each of said second opposed walls, each said handle assembly including a generally U-shaped handle having a gripping portion and arm members extending from the ends thereof, said arm members being received within pocket apertures near the top of each said second opposed walls so that said gripping portion is normally recessed within the profile of each of said second opposed walls, and means to maintain said arm members within said pocket apertures so that when said gripping portion is lifted, said handle may be rotated and used to lift the container.

24. A container according to claim 1 further comprising means to removably position said thermoelectric power means in said recess in said one of said first opposed walls, a power cord attached to said thermoelectric power means, plug means carried by said cord to connect said thermoelectric power means to a source of electric power, switch means associated with said plug means to direct said thermoelectric power means to selectively cool or heat the interior of the container, and means in said base surface to direct said cord to generally the center thereof and then selectively toward any of said walls.

25. A container according to claim 24 further comprising a handle assembly positioned near the top of each of said second opposed walls, each said handle assembly including a generally U-shaped handle having a gripping portion and arm members extending from the ends thereof, said arm members being received within pocket apertures near the top of each said second opposed walls so that said gripping portion is normally recessed within the profile of each of said second opposed walls, and means to maintain said arm members within said pocket apertures so that when said gripping portion is lifted, said handle may be rotated and used to lift the container.

26. A container according to claim 1 further comprising means to removably position said thermoelectric power means in said recess in said one of said first opposed walls, a power cord attached to said thermoelectric power means, plug means carried by said cord to connect said thermoelectric power means to a source of electric power, switch means associated with said plug means to direct said thermoelectric power means to selectively cool or heat the interior of the container, and means formed in said base surface and at least one of said walls to receive said cord for storing the same.

27. A container comprising a base surface, first opposed walls extending from said base surface, second opposed walls extending from said base surface, together said first opposed walls and said second opposed walls forming an opening for the container opposite to said base surface, a door for closing said opening, hinge means attaching said door to one of said first opposed walls, thermoelectric power means positioned in one of said first opposed walls to selectively cool or heat the interior of the container, a power cord attached to said thermoelectric power means, and means in said base surface to direct said cord to generally the center thereof and then selectively toward any of said walls, the container thus being positionable selectively on said base surface or either of said second opposed walls.

28. A container according to claim 27 further comprising a handle assembly positioned near the top of each of said second opposed walls, each said handle assembly including a generally U-shaped handle having a gripping portion and arm members extending from the ends thereof, said arm members being received within pocket apertures near the top of each said second opposed walls so that said gripping portion is normally recessed within the profile of each of said second opposed walls, and means to maintain said arm members within said pocket apertures so that when said gripping portion is lifted, said handle may be rotated and used to lift the container.

29. A container according to claim 27 further comprising means formed in said base surface and at least one of said walls to receive said cord for storing the same.

30. A container according to claim 29 further comprising plug means carried by said cord to connect said thermoelectric power means to a source of electric power, and switch means associated with said plug means to direct said thermoelectric power means to selectively cool or heat the interior of the container.

31. A container according to claim 29 further comprising a handle assembly positioned near the top of each of said second opposed walls, each said handle assembly including a generally U-shaped handle having a gripping portion and arm members extending from the ends thereof, said arm members being received within pocket apertures near the top of each said second opposed walls so that said gripping portion is normally recessed within the profile of each of said second opposed walls, and means to maintain said arm members within said pocket apertures so that when said gripping portion is lifted, said handle may be rotated and used to lift the container.

32. A container according to claim 29 further comprising means to removably position said thermoelectric power means in said one of said first opposed walls.

33. A container according to claim 32 further comprising plug means carried by said cord to connect said thermoelectric power means to a source of electric power, and switch means associated with said plug means to direct said thermoelectric power means to selectively cool or heat the interior of the container.

34. A container comprising a base surface, a plurality of walls extending from said base surface forming an opening for the container opposite to said base surface, a door for closing said opening, a thermoelectric power module to selectively cool or heat the interior of the container, a recess opening from the bottom of one of said walls to receive said thermoelectric power module, and means to removably position said module in said recess in said one of said walls.

35. A container according to claim 34 wherein said means to removably position includes rail means on said thermoelectric power module and track means in said recess, said rail means being received by said track means.

36. A container according to claim 35 further comprising flanges extending outwardly from said thermoelectric power module, said flanges having apertures therein to receive fasteners to attach said thermoelectric power module within said recess.

37. A container according to claim 34 further comprising a power cord attached to said thermoelectric power module, plug means carried by said cord to connect said thermoelectric power module to a source of electric power, and switch means associated with said plug means to direct said thermoelectric power module to selectively cool or heat the interior of the container.

38. A container according to claim 37 further comprising means in said base surface to direct said cord to generally the center thereof and then selectively toward the other of said walls.

39. A container according to claim 37 further comprising means formed in said base surface and at least one of said walls to receive said cord for storing the same.

40. A container according to claim 35 further comprising a handle assembly positioned near the top of two opposed of said walls, each said handle assembly including a generally U-shaped handle having a gripping portion and arm members extending from the ends thereof, said arm members being received within pocket apertures near the top of each said two opposed of said walls so that said gripping portion is normally recessed within the profile of each said two opposed of said walls, and means to maintain said arm members within said pocket apertures so that when said gripping portion is lifted, said handle may be rotated and used to lift the container.

41. A container according to claim 40 further comprising means in said base surface to direct said cord to generally the center thereof and then selectively toward the other of said walls.

42. A container according to claim 40 further comprising means formed in said base surface and at least one of said walls to receive said cord for storing the same.

43. A container according to claim 34 further comprising a power cord attached to said thermoelectric module, and means in said base surface to direct said cord to generally the center thereof and then selectively toward the other of said walls.

44. A container according to claim 43 further comprising means formed in said base surface and at least one of said walls to receive said cord for storing the same.

45. A container according to claim 43 further comprising a handle assembly positioned near the top of two opposed of said walls, each said handle assembly including a generally U-shaped handle having a gripping portion and arm members extending from the ends thereof, said arm members being received within pocket apertures near the top of each said two opposed of said walls so that said gripping portion is normally recessed within the profile of each said two opposed of said walls, and means to maintain said arm members within said pocket apertures so that when said gripping portion is lifted, said handle may be rotated and used to lift the container.

46. A container according to claim 45 further comprising means formed in said base surface and at least one of said walls to receive said cord for storing the same.

47. A container according to claim 46 further comprising plug means carried by said cord to connect said thermoelectric power module to a source of electric power, and switch means associated with said plug means to direct said thermoelectric power module to selectively cool or heat the interior of the container.

48. A container according to claim 34 further comprising a power cord attached to said thermoelectric power module, and means formed in said base surface and at least one of said walls to receive said cord for storing the same.

49. A container according to claim 48 further comprising means in said base surface to direct said cord to generally the center thereof and then selectively toward the other of said walls, plug means carried by said cord to connect said thermoelectric power module to a source of electric power, and switch means associated with said plug means to direct said thermoelectric power module to selectively cool or heat the interior of the container.

50. A container according to claim 34 further comprising a handle assembly positioned near the top of two opposed of said walls, each said handle assembly including a generally U-shaped handle having a gripping portion and arm members extending from the ends thereof, said arm members being received within pocket apertures near the top of each said two opposed of said walls so that said gripping portion is normally recessed within the profile of each said two opposed of said walls, and means to maintain said arm members within said pocket apertures so that when said gripping portion is lifted, said handle may be rotated and used to lift the container.

51. A container according to claim 50 further comprising a power cord attached to said thermoelectric power module, and means formed in said base surface and at least one of said walls to receive said cord for storing the same.

52. A container comprising a base surface, a plurality of walls extending from said base surface forming an opening for the container opposite to said base surface, a door for closing said opening, thermoelectric power means positioned in one of said walls to selectively cool or heat the interior of the container, a power cord attached to said thermoelectric power means, plug means including a body member carried by said cord to connect said thermoelectric power means to a source of electric power, switch means carried by said body member to direct said thermoelectric power means to selectively cool or heat the interior of the container, and indicator means on said body member to visually display whether said thermoelectric power means is cooling or heating the interior of the container.

53. A container according to claim 52 wherein said plug means includes a tip portion configured to be received by an automotive cigarette lighter.

54. A container according to claim 52 further comprising means in said base surface to direct said cord to generally the center thereof and then selectively toward the other of said walls.

55. A container according to claim 54 further comprising means formed in said base surface and at least one of said walls to receive said cord for storing the same.

56. A container according to claim 54 further comprising a handle assembly positioned near the top of two opposed of said walls, each said handle assembly including a generally U-shaped handle having a gripping portion and arm members extending from the ends thereof, said arm members being received within pocket apertures near the top of each said two opposed of said walls so that said gripping portion is normally recessed within the profile of each said two opposed of said walls, and means to maintain said arm members within said pocket apertures so that when said gripping portion is lifted, said handle may be rotated and used to lift the container.

57. A container according to claim 56 further comprising means formed in said base surface and at least one of said walls to receive said cord for storing the same.

58. A container according to claim 52 further comprising means formed in said base surface and at least one of said walls to receive said cord for storing the same.

59. A container according to claim 58 further comprising a handle assembly positioned near the top of two opposed of said walls, each said handle assembly including a generally U-shaped handle having a gripping portion and arm members extending from the ends thereof, said arm members being received within pocket apertures near the top of each said two opposed of said walls so that said gripping portion is normally recessed within the profile of each said two opposed of said walls, and means to maintain said arm members within said pocket apertures so that when said gripping portion is lifted, said handle may be rotated and used to lift the container.

60. A container according to claim 52 further comprising a handle assembly positioned near the top of two opposed of said walls, each said handle assembly including a generally U-shaped handle having a gripping portion and arm members extending from the ends thereof, said arm members being received within pocket apertures near the top of each said two opposed of said walls so that said gripping portion is normally recessed within the profile of each said two opposed of said walls, and means to maintain said arm members within said pocket apertures so that when said gripping portion is lifted, said handle may be rotated and used to lift the container.

61. A container comprising a base surface, a plurality of walls extending from said base surface forming an opening for the container opposite to said base surface, a door for closing said opening, thermoelectric power means positioned in one of said walls to selectively cool or heat the interior of the container, a power cord attached to said thermoelectric power means, and means in said base surface to direct said cord to generally the center thereof and then selectively toward the other of said walls.

62. A container according to claim 61 wherein said means in said base surface includes a generally central routing junction recess and a plurality of recessed channels extending from said recess to each of said walls.

63. A container according to claim 62 further comprising means to grip said cord positioned in each of said channels.

64. A container according to claim 61 wherein said thermoelectric power means is positioned in a recess in one of said walls and said power cord is attached to said thermoelectric power means near the bottom thereof, said means in said base surface including a plurality of recessed channels, one of which extends to said recess and the others of which extend to the others of said walls.

65. A container according to claim 61 further comprising means formed in said base surface and at least one of said walls to receive said cord for storing the same.

66. A container according to claim 61 further comprising a handle assembly positioned near the top of two opposed of said walls, each said handle assembly including a generally U-shaped handle having a gripping portion and arm members extending from the ends thereof, said arm members being received within pocket apertures near the top of each said two opposed of said walls so that said gripping portion is normally recessed within the profile of each said two opposed of said walls, and means to maintain said arm members within said pocket apertures so that when said gripping portion is lifted, said handle may be rotated and used to lift the container.

67. A container according to claim 66 further comprising means formed in said base surface and at least one of said walls to receive said cord for storing the same.

68. A container comprising a base surface, a plurality of walls extending from said base surface forming an opening for the container opposite to said base surface, a door for closing said opening, thermoelectric power means positioned in one of said walls to selectively cool or heat the interior of the container, a power cord attached to said thermoelectric power means, means formed in said base surface and at least one of said walls to receive said cord for storing the same and including a recess positioned in said base surface and a said wall opposite said one of said walls, and means to direct said cord from said thermoelectric power means to said recess.

69. A container according to claim 68 wherein said means to direct includes a recessed channel in said base surface.

70. A container according to claim 68 wherein said means formed in said base surface and at least one of said walls includes peg means around which said cord may be wound.

71. A container according to claim 70 wherein said means formed in said base surface and at least one of said walls includes a recess, and slot means in said recess to carry said peg means.

72. A container according to claim 68 further comprising a handle assembly positioned near the top of two opposed of said walls, each said handle assembly including a generally U-shaped handle having a gripping portion and arm members extending from the ends thereof, said arm members being received within pocket apertures near the top of each said two opposed of said walls so that said gripping portion is normally recessed within the profile of each said two opposed of said walls, and means to maintain said arm members within said pocket apertures so that when said gripping portion is lifted, said handle may be rotated and used to lift the container.

73. A container comprising a base surface, a plurality of walls extending from said base surface forming an opening for the container opposite to said base surface, a door for closing said opening, thermoelectric power means positioned in one of said walls to selectively cool or heat the interior of the container, and a handle assembly positioned near the top of two opposed of said walls, each said handle assembly including a generally U-shaped handle having a gripping portion and arm members extending from the end thereof, said arm members being received within pocket apertures near the top of each said two opposed of said walls so that said gripping portion is normally recessed within the profile of each said two opposed of said walls, and means to maintain said arm members within said pocket apertures so that when said gripping portion is lifted, said arm members move through said pocket apertures and then said handle may be rotated and used to lift the container.

74. A container according to claim 73 wherein said arm members include split ends forming tine members, said handle being positioned in said pocket apertures by compressing said tine members toward each other.

75. A container according to claim 74 wherein said tine members have opposed recesses on the inside thereof, said means to maintain said arm members within said pocket apertures including plug means positioned between said tine members and engaging said recesses.

76. A container according to claim 74 wherein said means to maintain said arm members within said pocket apertures includes slots formed on the outside of said tine members to engage the bottom of said pocket apertures when said arm members are positioned through said pocket apertures.

77. A container according to claim 76 wherein said means to maintain said arm members within said pocket apertures include hubs extending from the outside of said tine members, and embossments on the end of said hubs, said slots being formed between said hubs and said embossments.

78. A container comprising a base surface, first opposed walls extending from said base surface, second opposed walls extending from said base surface, together said first opposed walls and said second opposed walls forming an opening for the container opposite to said base surface, a door for closing said opening, hinge means attaching said door to one of said first opposed walls, thermoelectric power means positioned in one of said first opposed walls to selectively cool or heat the interior of the container, the container thus being positionable selectively on said base surface or either of said second opposed walls, means to removably position said thermoelectric power means in its one of said first opposed walls, a power cord attached to said thermoelectric power means, plug means carried by said cord to connect said thermoelectric power means to a source of electric power, switch means associated with said plug means to direct said thermoelectric power means to selectively cool or heat the interior of the container, means in said base surface to direct said cord to generally the center thereof and selectively toward the other of said first opposed walls and toward said second opposed walls, means formed in said base surface and one of said walls to receive said cord for storing the same, and a handle assembly positioned near the top of said second opposed walls, each said handle assembly including a generally U-shaped handle having a gripping portion and arm members extending from the ends thereof, said arm members being received within pocket apertures near the top of each said second opposed walls so that said gripping portion is normally recessed within the profile of each said second opposed walls, and means to maintain said arm members within said pocket apertures so that when said gripping portion is lifted, said handle may be rotated and used to lift the container.

* * * * *